US005941756A

United States Patent [19]

Chou

[11] Patent Number: 5,941,756

[45] Date of Patent: Aug. 24, 1999

[54] MOTION TOY

[75] Inventor: Jin-Long Chou, Taipei Hsien, Taiwan

[73] Assignee: Blue Ridge Designs, Inc., Boone, N.C.

[21] Appl. No.: 09/014,103

[22] Filed: Jan. 27, 1998

[51] Int. Cl.[6] ..... A63H 3/20; A63H 13/00; G09F 19/08

[52] U.S. Cl. ..... 446/330; 446/353; 40/414

[58] Field of Search ..... 446/3, 339, 352, 446/353, 487, 278; 40/414

[56] References Cited

U.S. PATENT DOCUMENTS

| | | | |
|---|---|---|---|
| 1,415,344 | 5/1922 | Haskell . | |
| 1,423,383 | 7/1922 | Zaiden . | |
| 1,674,943 | 6/1928 | Berger . | |
| 1,685,358 | 9/1928 | Harcourt . | |
| 2,637,936 | 5/1953 | Dale et al. . | |
| 2,691,845 | 10/1954 | Jepson | 446/352 |
| 3,613,299 | 10/1971 | Amici et al. . | |
| 3,643,374 | 2/1972 | Gunther et al. . | |
| 3,660,931 | 5/1972 | Gardel et al. . | |
| 3,888,023 | 6/1975 | Genin . | |
| 4,040,206 | 8/1977 | Kimura . | |
| 4,136,874 | 1/1979 | McCord | 446/330 |
| 4,545,775 | 10/1985 | Kim . | |
| 4,676,764 | 6/1987 | Yeu . | |
| 4,801,285 | 1/1989 | Yeu . | |
| 4,828,530 | 5/1989 | Lee . | |
| 4,836,819 | 6/1989 | Oishi et al. . | |
| 4,846,752 | 7/1989 | Combs . | |
| 4,867,730 | 9/1989 | Lee . | |
| 4,869,703 | 9/1989 | Ong . | |
| 4,901,459 | 2/1990 | Lee | 40/414 |
| 4,944,708 | 7/1990 | Kawabe . | |
| 5,022,533 | 6/1991 | Lin | 211/1.5 |
| 5,147,238 | 9/1992 | Kelley et al. . | |
| 5,176,560 | 1/1993 | Wetherell et al. . | |
| 5,224,896 | 7/1993 | Terzian . | |
| 5,259,806 | 11/1993 | Chang . | |
| 5,609,340 | 3/1997 | Chuang . | |
| 5,735,726 | 4/1998 | Cohen . | |

FOREIGN PATENT DOCUMENTS

| | | | |
|---|---|---|---|
| 535765 | 12/1958 | Belgium | 446/487 |

*Primary Examiner*—Kien T. Nguyen
*Assistant Examiner*—Laura Fossum
*Attorney, Agent, or Firm*—Smith, Gambrell & Russell, LLP; Beveridge, DeGrandi, Weilacher & Young Intellectual Property Group

[57] ABSTRACT

A motion toy includes a frame structure covered with a decorated shell and a power drive controlled to move parts of the frame structure. The frame structure has two vertical upper side boards and two vertical lower side boards hinged together, a horizontal shoulder board coupled between the vertical side boards at the top, a horizontal upper link coupled between the vertical upper side boards and the vertical lower side boards, and a horizontal bottom link coupled between the vertical lower side boards at the bottom side. This bottom line is reciprocated by the power drive. Each vertical upper side boards has a respective sector gear respectively meshed with a respective sector gear on the vertical lower side boards.

9 Claims, 5 Drawing Sheets

MOTION TOY

BACKGROUND OF THE INVENTION

The present invention relates to motion toys, and more particularly a motion toy which uses a reversible motor to turn a frame structure, causing vertical upper side boards and vertical lower side boards of the frame structure to oscillate in reversed directions.

A variety of motion toys have been disclosed and have appeared on the market. These motion toys commonly use a motor to turn a transmission gear train, causing the transmission gear train to move eccentric rods or cams, so as to move movable parts of the toy back and forth. This motion mode is monotonous and less attractive.

SUMMARY OF THE INVENTION

The present invention provides a motion toy which comprises a frame structure covered with a decorated shell and a power drive controlled to move parts of the frame structure. The frame structure comprises two vertical upper side boards and two vertical lower side boards hinged together, a horizontal shoulder board coupled between the vertical side boards at the top, a horizontal upper link coupled between the vertical upper side boards and the vertical lower side boards, and a horizontal bottom link coupled between the vertical lower side boards at the bottom side and reciprocated by the power drive, the vertical upper side boards having a respective sector gear respectively meshed with respective sector gears on the vertical lower side boards. The power drive comprises a reversible motor controlled by a control circuit to reciprocate the horizontal bottom link through a transmission mechanism.

DETAILED DESCRIPTION OF THE PREFERRED EMBODIMENT

Figure 1:
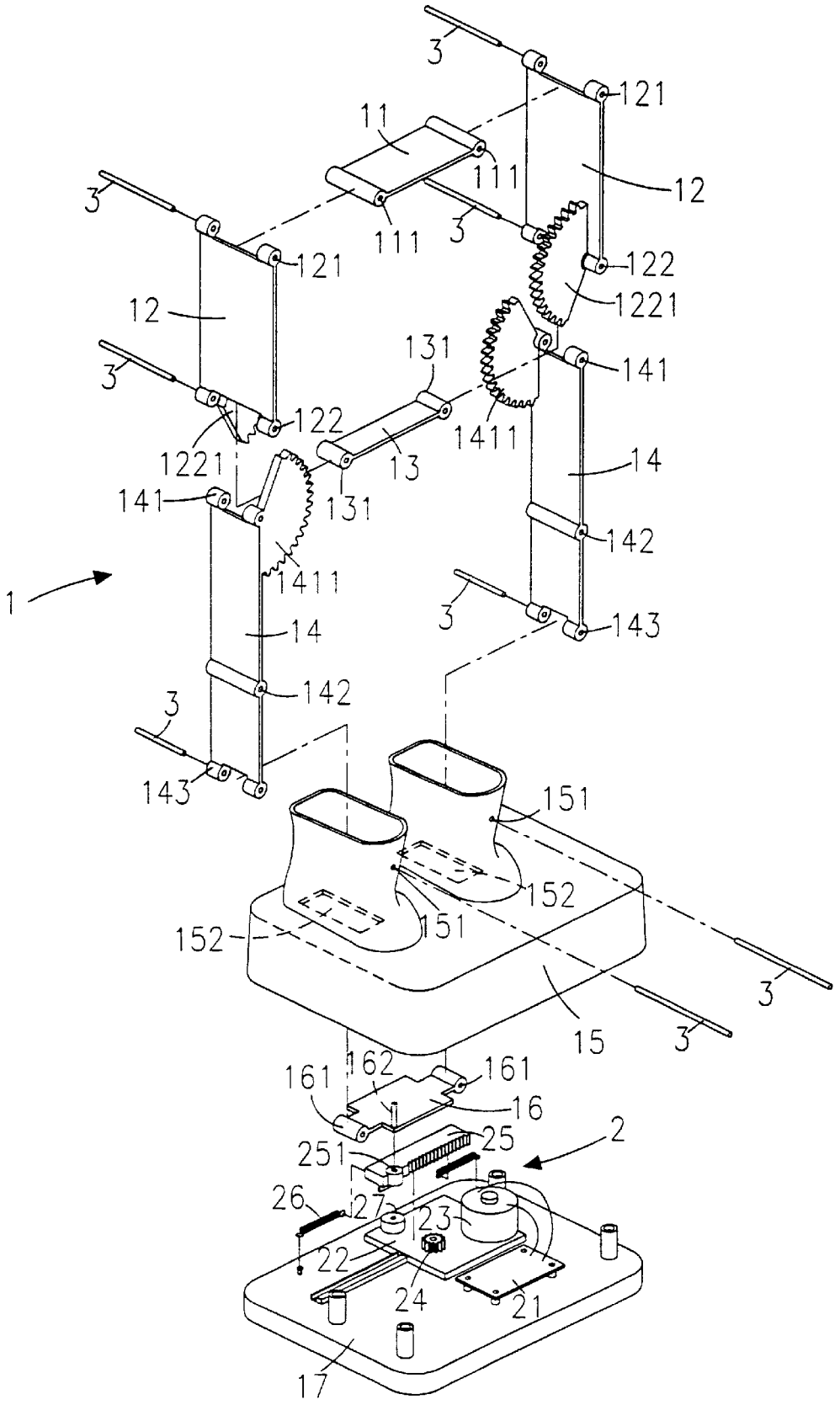
FIG. 1 is an exploded view of a motion toy according to the present invention (the decorative shell excluded).

Referring to FIG. 1, a motion toy in accordance with the present invention is generally comprised of a frame structure 1, a power drive 2, and a plurality of pivot pins 3. The frame structure 1 is covered with a decorative shell (not shown) having any of a variety of designs (the decorative shell can have the shape of a Santa Claus, a little bear, etc.).

Figure 2:
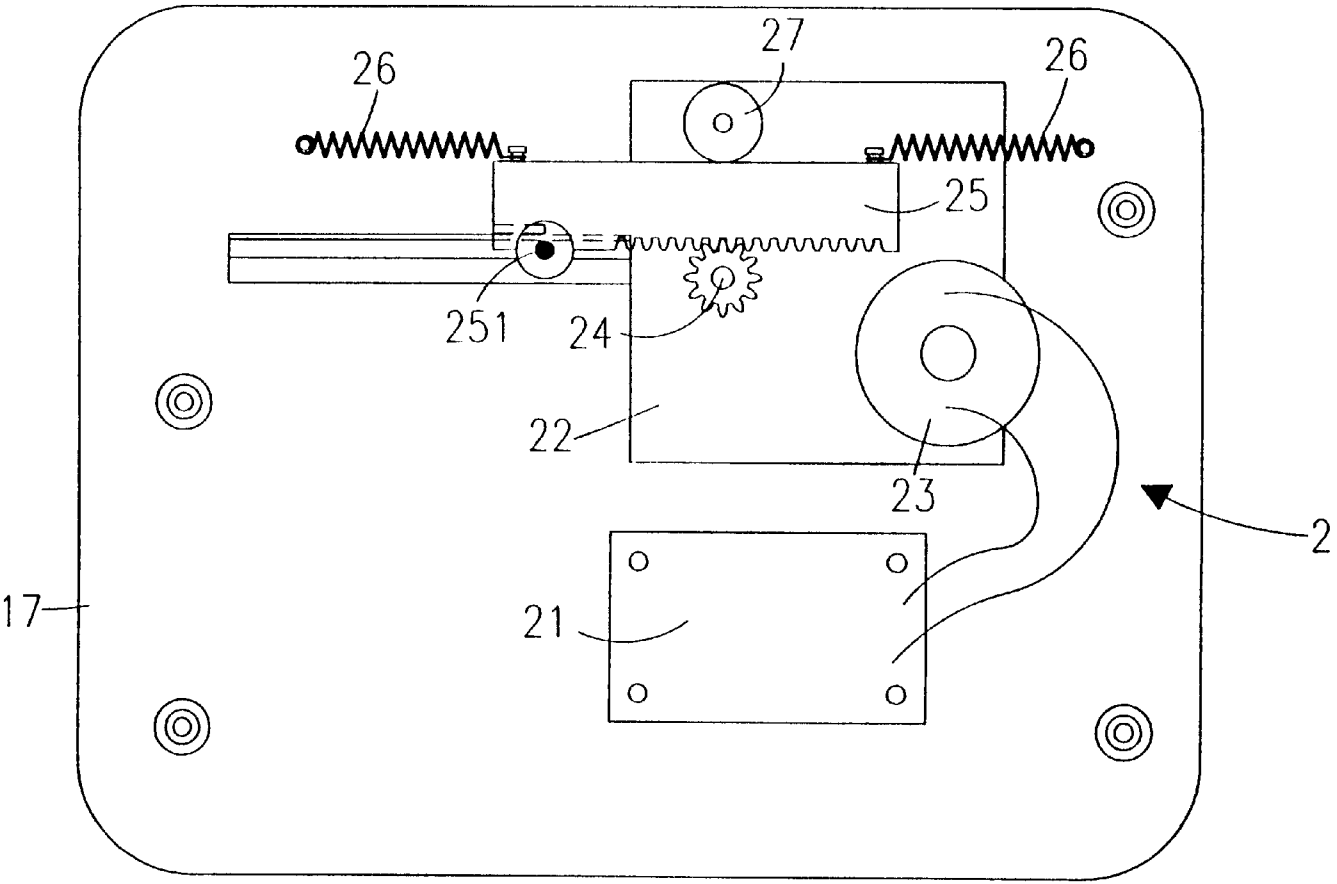
FIG. 2 is a top plain view of the power drive for the motion toy according to the present invention.
Figure 3:
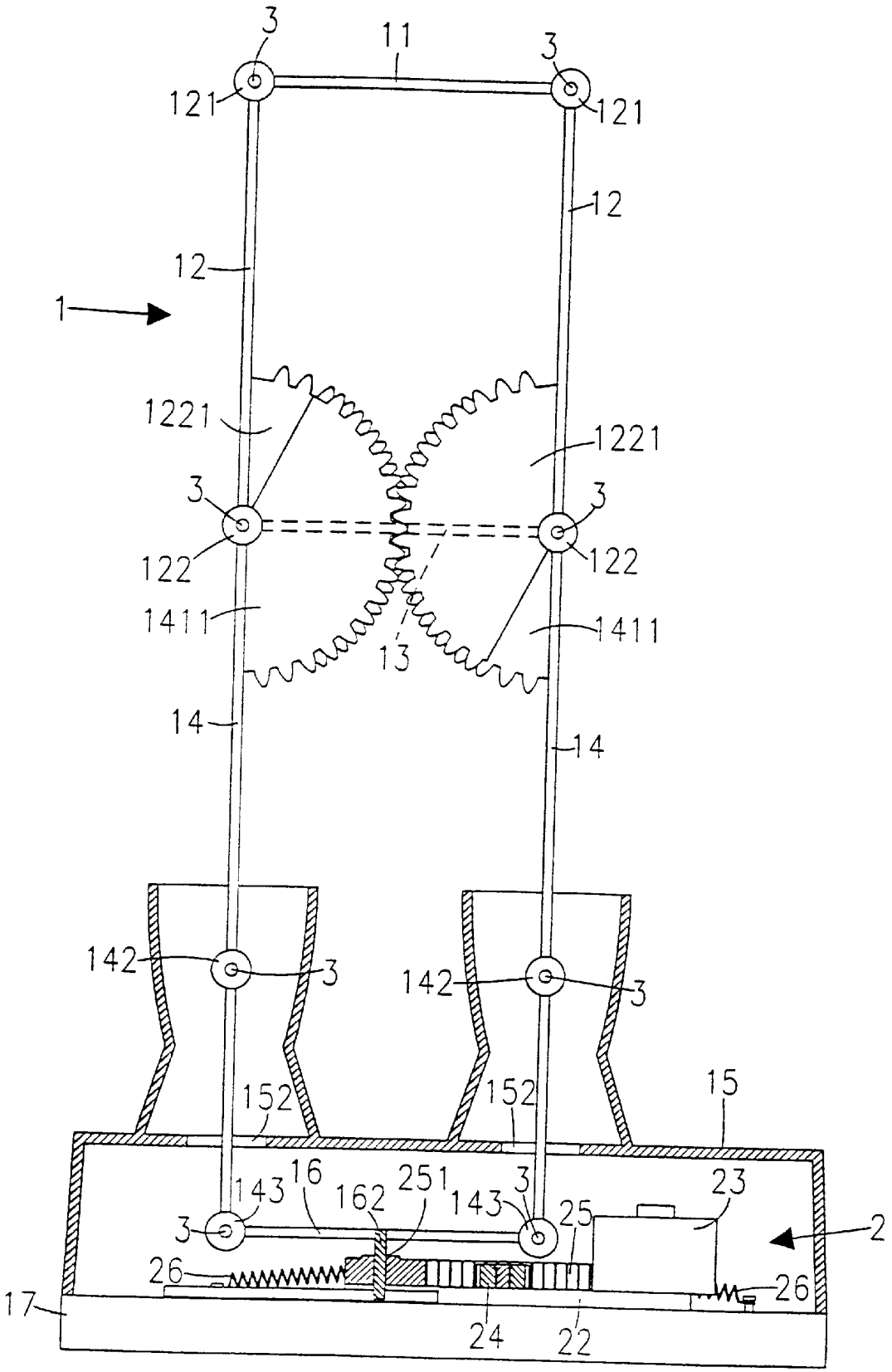
FIG. 3 is a sectional view of the present invention, showing the upper side boards and the lower side boards vertically aligned.

Referring to FIGS. 2 and 3 and FIG. 1 again, the frame structure 1 comprises a bottom plate 17 and a hollow foot plate 15 covering on the bottom plate 17, the hollow foot plate 15 having two boot-like receptacles 151 and two through holes 152 through the bottom side of the boot-like receptacles 151. The frame structure 1 further includes a horizontal shoulder board 11 having two transverse axle holes 111 at two sides, and two vertical upper side boards 12 bilaterally hinged to the shoulder board 11, each vertical upper side board 12 having two first barrels 121 bilaterally disposed at the top side and pivotably connected to two opposite ends of one transverse axle hole 111 on the horizontal shoulder board 11 by one pivot pin 3. Two second barrels 122 are bilaterally disposed at the bottom side of the upper side boards 11, and a sector gear 1221 are at the bottom side of the upper side boards 11. A horizontal upper link 13 is coupled between the second barrels 122 of the vertical upper side boards 12, the horizontal upper link 13 having two axle holes 131 at two opposite sides. Two vertical lower side boards 14 are respectively hinged to the vertical upper side boards 12 and inserted through the through holes 152 in the boot-like receptacles 151 of the hollow foot plate 15, each vertical lower side board 14 having two first barrels 141 bilaterally disposed at the top and pivotably connected to two opposite ends of one axle hole 131 on the horizontal upper link 13 between the second barrels 122 of one vertical upper side board 12 by one pivot pin 3. A sector gear 1411 is provided at the top of the vertical lower side boards 14, and this sector gear 1411 is meshed with the sector gear 1221 on one vertical upper side board 12. A transverse axle hole 142 on the middle of the vertical lower side boards 14 pivotably couples to the inside wall of one boot-like receptacle 151 on the hollow foot plate 15 by one pivot pin 3. Two second barrels 143 are bilaterally disposed at the bottom of the vertical lower side boards 14, and a horizontal bottom link 16 coupled between the vertical lower side boards 14 at the bottom inside the foot plate 15, the horizontal bottom link 16 having two transverse axle holes 161 at two opposite sides respectively pivotably connected between the second barrels 143 of the vertical lower side boards 14 by a respective pivot pin 3.

The power drive 2 comprises a motor mount 22 fixedly mounted on the bottom plate 17 inside the hollow foot plate 15, a reversible motor 23 mounted on the motor mount 22, a control circuit 21 mounted on the bottom plate 17 for controlling the operation of the reversible motor 23, a transmission gear 24 mounted on the motor mount 22 and coupled to the output shaft of the reversible motor 23 through a reduction gear train (not shown), a roller 27 horizontally supported on the motor mount 22, a movable rack 25 having a toothed front side meshed with the transmission gear 24, a plain rear side supported on the roller 27, and a locating hole 251 at one end of the toothed front side and connected to the horizontal bottom link 16 by a pin 162, and two tensile springs 26 respectively connected between the bottom plate 17 and two opposite ends of the plain rear side of the movable rack 25.

Figure 4:
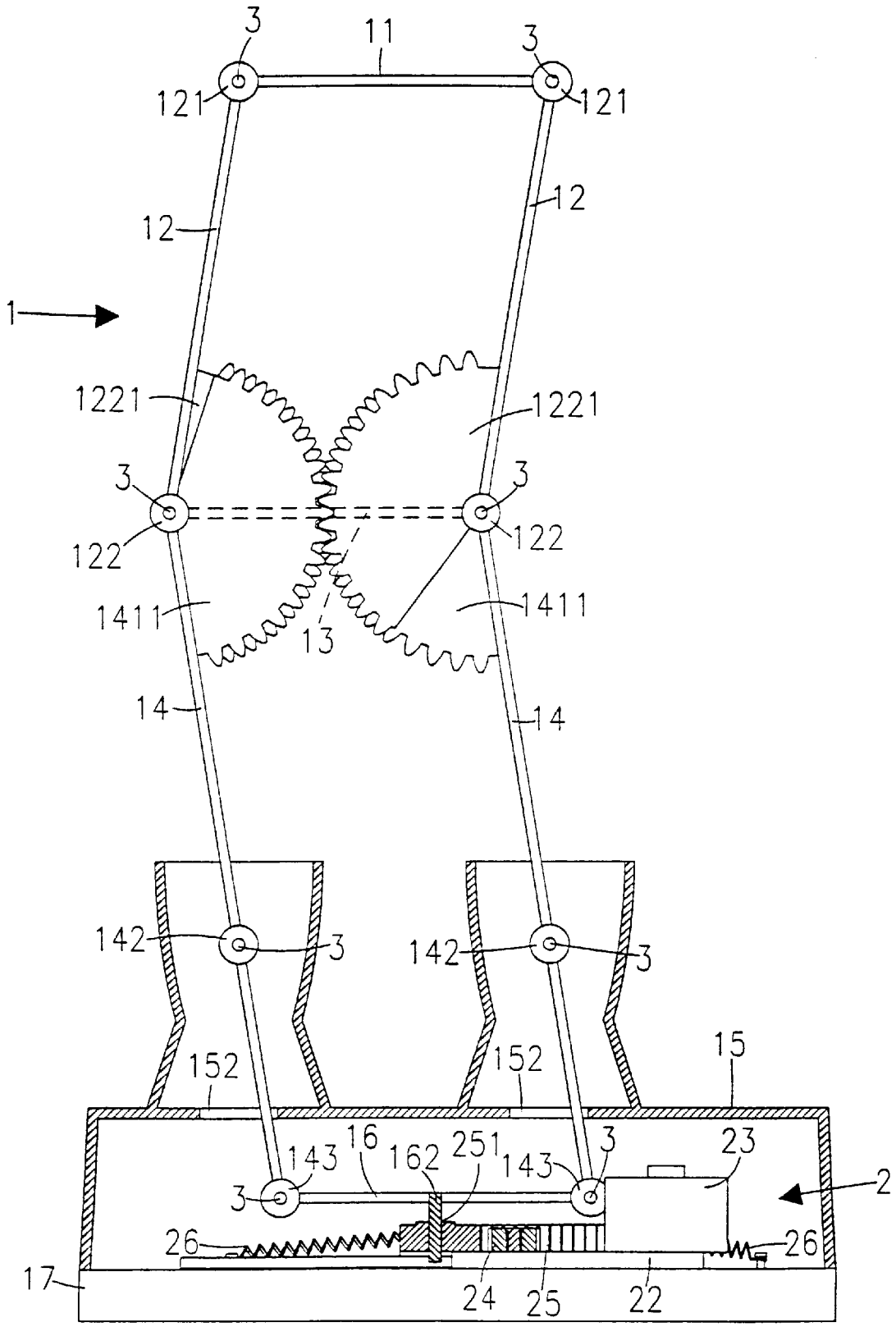
FIG. 4 is another sectional view of the present invention, showing the lower side boards tilted leftwards and the upper side boards tilted rightward.
Figure 5:
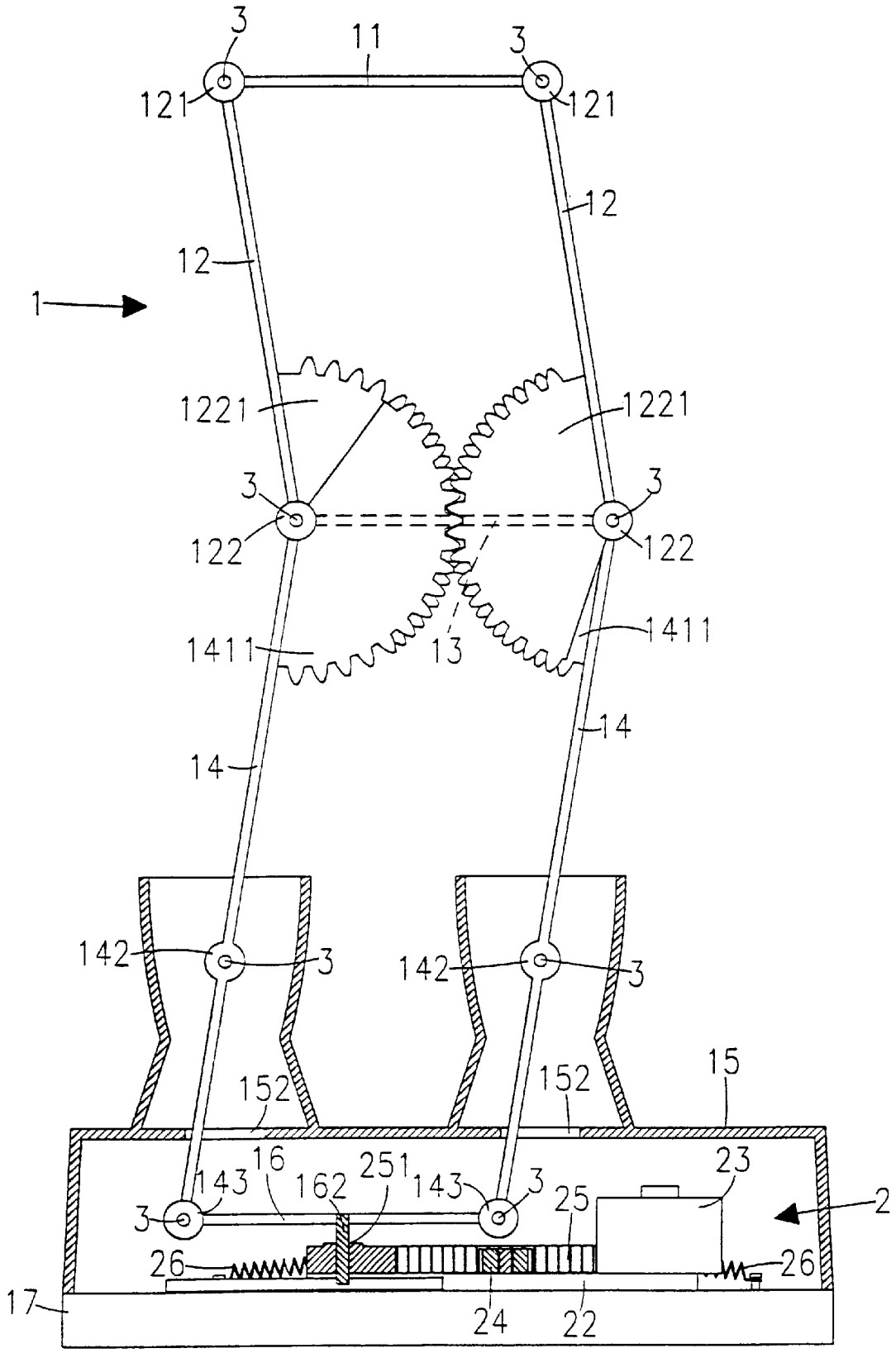
FIG. 5 is still another sectional view of the present invention, showing the lower side boards tilted rightward and, the upper side boards tilted leftward.

Referring to FIGS. 4 and 5 and FIG. 3 again, when started, the reversible motor 23 is controlled by the control circuit 21 to turn the transmission gear 24 clockwise and counterclockwise alternatively, causing the transmission gear 24 to move the movable rack 25 back and forth horizontally, thereby causing the horizontal bottom link 16 to be moved with the movable rack 25 back and forth. When the horizontal bottom link 16 is moved rightwards (see FIG. 4), the vertical lower side boards 14 are tilted leftwards, and the vertical upper side boards 12 are tilted rightwards due to the engagement between the sector gears 1221;1411. On the contrary, when the horizontal bottom link 16 is moved leftwards (see FIG. 5), the vertical lower side boards 14 are tilted rightwards, and the vertical upper side boards 12 are tilted leftwards.

While only one embodiment of the present invention has been shown and described, it will be understood that various modifications and changes could be made thereunto without departing from the spirit and scope of the invention disclosed.

What the invention claimed is:

1. A movable toy, comprising:

a frame structure, the frame structure including:

a base member defining a chamber;

a first lower side board extending into the base member;

a second lower side board extending into the base member;

a lower link pivotally connected to the first lower side board and the second lower side board at a lower end of the lower side boards, wherein the lower link is located in the chamber of the base member;

an upper link pivotally connected to the first lower side board and the second lower side board at an upper end of the lower side boards;

a first upper side board;

a second upper side board, wherein the upper link is pivotally connected to the first upper side board and the second upper side board at a lower end of the upper side boards, a shoulder board pivotally connected to the first upper side board and the second upper side board at an upper end of the upper side boards; and a power drive operatively connected to the lower link reciprocating the lower link in a side to side motion and moving the movable toy about the pivotal connections.

2. A movable toy according to claim 1, wherein the lower end of at least one of the first upper side board or the second upper side board includes a first sector gear, and wherein the upper end of at least one of the first lower side board or the second lower side board includes a second sector gear, wherein the first sector gear movably meshes with the second sector gear.

3. A movable toy according to claim 1, wherein:

the lower end of the first upper side board includes a first sector gear and the upper end of the first lower side board includes a second sector gear, wherein the first sector gear movably meshes with the second sector gear; and the lower end of the second upper side board includes a third sector gear and the upper end of the second lower side board includes a fourth sector gear, wherein the third sector gear movably meshes with the fourth sector gear.

4. A movable toy according to claim 1, wherein the power drive includes:

a reversible motor mounted in the base member;

a transmission gear driven by the reversible motor, wherein the transmission gear is operatively engaged with the lower link for moving the lower link in a reciprocating manner.

5. A movable toy according to claim 4, wherein the transmission gear is operatively engaged with the lower link via a rack that meshes with the transmission gear and connects to the lower link.

6. A movable toy according to claim 1, wherein each of the first and second lower side boards is pivotally connected to the base member at a location between the upper end of the lower side boards and the lower end of the lower side boards.

7. A moveable toy comprising:

a frame structure, said frame structure including a bottom plate; a hollow foot plate covering said bottom plate, said hollow foot plate having tow boot-like receptacles with two through holes defined in said boot-like receptacles; a horizontal shoulder board having two transverse axle holes at two sides; two vertical upper side boards bilaterally hinged to said shoulder board, said vertical upper side boards each having two first barrels bilaterally disposed at a top side and pivotably connected to two opposite ends of one transverse axle hole on said horizontal shoulder board by one pivot pin, two second barrels bilaterally disposed at a bottom side, and at least one bottom sector gear; a horizontal upper link coupled between the second barrels of said vertical upper side boards, said horizontal upper link having two axle holes at two opposite sides; two vertical lower side boards respectively hinged to said vertical upper side boards and inserted into the through holes defined in said boot-like receptacles of said hollow foot plate, said vertical lower side boards each having two first barrels bilaterally disposed at a top side and pivotably connected to two opposite ends of one axle hole on said horizontal upper link between the second barrels of one vertical upper side board by a pivot pin, at least one top sector gear respectively meshed with the at least one bottom sector gear on one vertical upper side board, a transverse axle hole at a middle of each vertical lower side board pivotably coupled to one boot-like receptacle on said hollow foot plate by a pivot pin, and two second barrels bilaterally disposed at a bottom side; and a horizontal bottom link coupled between said vertical lower side boards inside said hollow foot plate, said horizontal bottom link having two transverse axle holes at two opposite sides respectively, pivotably connected between the second barrels of said vertical lower side boards by a respective pivot pin; and a power drive controlled to reciprocate said horizontal bottom link, said power drive including a motor mount fixedly mounted on said bottom plate inside said hollow foot plate; a reversible motor mounted on said motor mount; a control circuit mounted on said bottom plate and controlled to turn said reversible motor forward and backward, alternatively; a transmission gear mounted on said motor mount and turned by said reversible motor; a roller horizontally supported on said motor mount; a movable rack having a toothed front side meshed with said transmission gear, a plain rear side supported on said roller, and a locating hole at one end of the toothed front side and connected to said horizontal bottom link by a pin; and two tensile springs respectively connected between said bottom plate and two opposite ends of said plain rear side of the movable rack.

8. The movable toy of claim 7, wherein the bottom horizontal link of said frame structure and the motor mount of said power drive is positioned between said vertical upper side boards or between said vertical lower side boards.

9. The movable toy of claim 7, wherein said vertical upper side boards each have a plurality of bottom sector gears, and said vertical lower side boards each have a plurality of top sector gears respectively meshed with the bottom sector gears on said vertical upper side boards.

* * * * *